United States Patent [19]

Clark

[11] 4,412,572

[45] Nov. 1, 1983

[54] SPLITTING AXE

[76] Inventor: Thomas A. Clark, Star Rte. 287, Box 5780, Potosi, Mo. 63664

[21] Appl. No.: 294,318

[22] Filed: Aug. 19, 1981

[51] Int. Cl.[3] ..... B26B 23/00

[52] U.S. Cl. ..... 145/2 R

[58] Field of Search ..... 145/2 R

[56] References Cited

U.S. PATENT DOCUMENTS

| | | | |
|---|---|---|---|
| 303,766 | 8/1884 | Trenor | 145/2 R |
| 520,738 | 5/1894 | Kelly | 145/2 R |
| 670,790 | 3/1901 | Leffingwell | 145/2 R |
| 1,729,365 | 9/1929 | Sells | 145/2 R |
| 4,300,606 | 11/1981 | Branson | 145/2 R |

FOREIGN PATENT DOCUMENTS

| | | | |
|---|---|---|---|
| 806408 | 6/1951 | Fed. Rep. of Germany | 145/2 R |
| 540465 | 10/1941 | United Kingdom | 145/2 R |

*Primary Examiner*—James G. Smith
*Assistant Examiner*—J. T. Zatarga
*Attorney, Agent, or Firm*—Kalish & Gilster

[57] ABSTRACT

A splitting axe comprises a head having an eye, and a handle having a portion received within the eye. The head has an anterior portion extending from one end of the eye and terminating in a cutting edge and a posterior portion extending from the opposite end of the eye to the end of the edge remote from the cutting edge. The mass of the head possesses a weight distribution providing an unbalanced disposition of the head on the handle with the center of gravity of the head being located within the eye and on an axis passing beyond the upper and lower edges of the eye which axis is parallel to, and forwardly of, the longitudinal axis of the eye. A retaining pin promotes securement of the handle within the eye and is located on the side of the longitudinal axis remote from the center of gravity.

3 Claims, 3 Drawing Figures

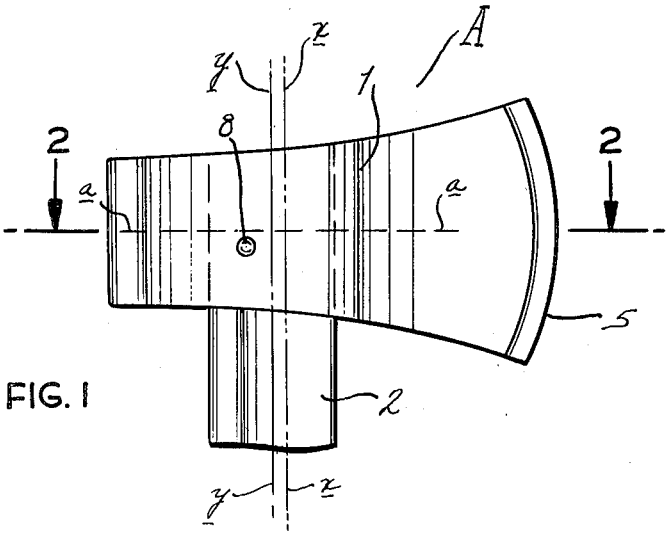
FIG. 1
FIG. 2
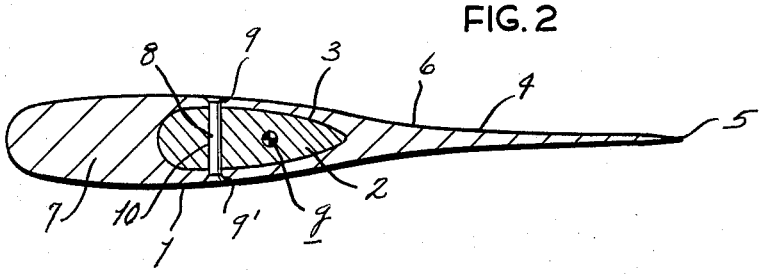
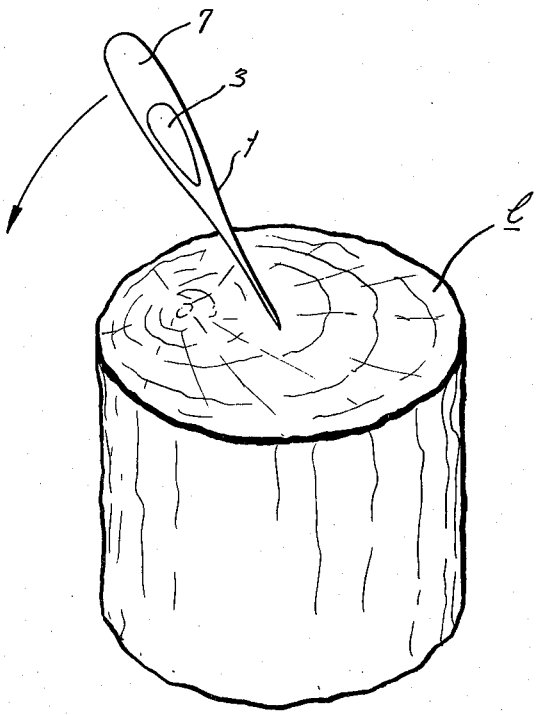
FIG. 3

SPLITTING AXE

BACKGROUND AND SUMMARY OF THE INVENTION

This invention relates in general to cutting tools and, more particularly, to new and useful improvements in a splitting axe.

Heretofore, various expedients have been considered in an effort to increase the efficiency of axes particularly designed for splitting purposes, such as, with rails and the like. One such effort is revealed in the Sandidge U.S. Pat. No. 1,272,538 which embodies an enlarged symmetrical wedge or splitting element formed adjacent the bit or cutting edge, which wedge will enter the slit formed upon the cutting action and promote a widening of the cut developed. Another expedient is revealed in Graham U.S. Pat. No. 653,234 disclosing a balanced blade designed to increase penetration by means of an involved configuration comprising beveled shoulders immediately rearwardly of the cutting edge and with there being a convex enlargement or knee posterior to each shoulder for cooperating therewith to form a fulcrum upon which the axe head may be rocked to loosen the head from an incision made by the blade.

It will thus be seen that in the prior art the axe heads are admittedly of a balanced character or with the weight thereof predominantly in the portion forwardly of the eye, that is, between the eye and the bit.

These prior art devices have thus relied upon the incorporation of specially contrived configurations to coordinate with the cutting edge to promote log splitting action and thus have not served to reduce the amount of power which must be exerted by the user to bring about the desired splitting action.

The present invention contemplates the provision of a splitting axe having thus a single cutting edge wherein the distribution of weight within the head is so uniquely arranged that upon the development of an incision within the wood to be split inertia resulting from the weight distribution promotes succeeding splitting action without the exertion of further effort by the user.

Therefore, it is an object of the present invention to provide an axe with a unique weight distribution within the head thereof so as to provide a gravity impelled continuum of the axe splitting action subsequent to the development of the incision.

It is a further object of the present invention to provide a splitting axe having a developed weight distribution such that the center of gravity will be located upon an axis passing through the eye of the axe head, but wherein such axis does not coincide with the vertical or longitudinal axis of the axe.

It is a still further object of the present invention to provide an axe of the type stated having a head weight arrangement which will bring about effective results with but limited penetration of the cutting edge.

It is another object of the present invention to provide an axe of the character stated embodying a novel pin for effecting securement between the axe head and the handle or helve; such pin thereby preventing accidental, potentially hazardous parting.

It is a further object of the present invention to provide an axe having a unique pin for interengagement of the helve or handle and head, being located a predetermined distance above the lower edge of the head to prevent inadvertent development of weakness in the lower zone of the head, as well as to prevent interference with the customary wedge utilized for handle retention.

It is a further object of the present invention to provide a splitting axe having a head of the character above-mentioned which is extremely effective in usage, bringing about optimum results, while requiring a relatively decreased demand upon the energies of the user; which may be economically produced as through conventional means, such as forging, and which is durable and reliable in usage.

BRIEF DESCRIPTION OF THE DRAWINGS

FIG. 1 is a side view of the splitting axe, with the handle partially cut away, constructed in accordance with and embodying the present invention.

FIG. 2 is a horizontal transverse sectional view taken on the line 2—2 of FIG. 1.

FIG. 3 is a view in partial perspective, illustrating the axe of the present invention as addressing a log for splitting action.

DESCRIPTION OF THE PRACTICAL EMBODIMENTS

Referring now by reference characters to the drawings which illustrate practical embodiments of the present invention, A generally designates an axe adapted for log splitting purposes incorporating a head 1 and a handle or helve 2 which is preferably of straight character. Said head 1, which may be produced in conventional fashion, such as by forging, incorporates an eye 3 for snugly receiving the upper end of handle 2. At the leading end of the anterior portion 4 of head 1 there is provided a bit or cutting edge 5 having the customary arcuated form, and with said anterior portion 4 tapering in the expected fashion rearwardly toward eye 3, as indicated at 6. Axe head 1 embodies a poll 7 or posterior portion which is of increased cross-section thereby according the poll relatively substantial weight, as described more fully hereinbelow.

With reference to FIGS. 1 and 2, it will be seen that a retaining pin 8, having an enlarged head at each end, is provided for extension through suitable countersunk openings 9,9' in the sides of head 1 and an aligned, extended opening 10 within that portion of the handle 2 received within eye 3. Said pin 8 thus manifestly provides a reliable union between head 1 and handle 2 obviating a hazardous potential for mutual displacement. However, said pin 8 is located with relative precision in light of the peculiar weight distribution within head 1, being located below the transverse center line, indicated a—a, of head 1 roughly at a point about 40% of the distance between the lower and upper edge of eye 3. This location assures of inhibiting any inadvertent weakness within the lower zone of the eye 3 avoiding rupture thereof, as well as to be located sufficiently downwardly from any wedge (not shown) that might normally be inserted within the upper end of eye 3 for enhancing the security of handle 2 in operative condition. It is apparent that pin 8 may be utilized on other comparable hand tools and thus constitutes a novel expedient for securing cooperating components in a safety promoting manner not hitherto considered.

It is to be further observed, particularly, that said pin 8 is also disposed within the rearward or cutting edge-remote zone of the received portion of handle 2, rearwardly of the vertical or longitudinal center line of eye 3, as represented in the drawings by the axis y—y, as well as posteriorly of the vertical axis x—x which passes through the center of gravity g of head 1.

To effect the desired weight distribution within head 1 it is critical that the center of gravity axis x—x pass through eye 3, as well as to be located forwardly of the longitudinal axis y—y of eye 3. Thus, it is important for the proper operation of splitting axe A that the center of gravity g be located within the eye 3, as well as on the cutting edge side, as it were, of the longitudinal or vertical center line of head 1. Thus, the term "longitudinal" is to be considered as passing through the upper and lower ends of axe head 1 when handle 2 is vertically presented (as shown in FIG. 1); it being recognized that by such usage the term "longitudinal" is referring to an axis which is not necessarily the longest axis of head 1. Hereinabove, the transverse center line a—a is the axis which progresses from the cutting edge posteriorly to the end extremity of the poll. Therefore, the aforesaid term should be understood as thus defined.

It will be appreciated that from a side elevational view, as FIG. 1, the unusual weight distribution of head 1 will not be readily visually apparent. FIG. 2 is, of course, not drawn to any particular scale, but serves to impart to the viewer the relative heaviness of poll or posterior portion 7, with the same being of less transverse extent than anterior portion 4 as shown in FIG. 2. It will be observed that this weight arrangement can be provided within the customary configuration of an axe head so that the same will not provide an especially unusual appearance different from conventional axe heads. Understandably, if desired, poll 7 could be configured in an extenuated form as long as the center of gravity was not shifted so as to coincide with, or be rearwardly of, the axe head longitudinal center line.

Turning now to FIG. 3, the utilization of the present invention will become more apparent. Axe A is addressed to the log 1 to be split, which may desirably be at a 30° angle. Cutting edge 5 will thus effect an incision within log 1 with the penetration or depth of cut being commensurate with the force applied and the relative narrowness of anterior portion 4; and with a fulcrum being developed along a line demarcating the upper limit of the penetrating portion of head 1. The exposed portion of axe head 1 will thus, by reason of the peculiar location of the center of gravity g, constitute a lever arm so that the same will be gravitationally attracted, as well as be subjected to inertia of the applied force so that the exposed portion of said axe head 1 will swing downwardly as in the direction indicated by an arrow in FIG. 3. By such action, the cutting edge 5 and its adjacent portion will be caused to move in an opposite direction having the effect of continuing the splitting action, all of which will have been effected without the further energy exertion by the user.

Accordingly, it will be seen that by the unique disposition of the center of gravity, the exposed portion of head 1 serves as a driving force to complete the log splitting action without requiring further effort on the part of the user. Thus, as head 1 is so peculiarly designed as to work with gravity, and to effect the development of a moment of force which conserves the strength of the user but without any diminution in the quality or extent of the splitting action.

From the foregoing it should be apparent that axe head 1 is thus uniquely designed, with the center of gravity being located on an axis which is removed from the vertical axis of the eye and is hence unbalanced with respect to the eye, and yet which will permit of a contouring which approximates the conventional appearance, and thereby avoids any grotesque appearance. Such an unusual distribution of forces provides log splitting with minimal effort by the user so that output may be substantially increased over what could be effected with existing splitting axes. As pointed out, pin 8 enhances the union between head 1 and handle 2 and the novel weight distribution brings about highly efficacious, yet unexpected, results through physical characteristics which demonstrate a marked contribution to the art.

What is claimed is:

1. A splitting axe having a head unbalanced with respect to a handle of said axe, said head having an eye, said handle having a portion received within said eye, said head having an anterior portion extending from one end of said eye and terminating in a cutting edge at one end of said head and a posterior portion extending from the opposite end of said eye to the end of said head remote from said cutting edge, the mass of said head having a weight distribution for providing an unbalanced disposition of said head on said handle whereby the center of gravity of said head is located within said eye and upon an axis passing through said center of gravity and parallel to the longitudinal center line of said eye, said axis being located anteriorly of said longitudinal center line, said center of gravity axis accordingly lying between said longitudinal center line and the anterior limit of said eye, said posterior portion being weighted and oriented posteriorly relative to said longitudinal center line.

2. A splitting axe according to claim 1 and further characterized by a retaining pin extending through the portion of the handle received within said eye and aligned lateral portions of said head, said pin being located downwardly of the transverse center line of said head, said transverse center line passing through said eye in a posterior-anterior direction, at a point below said transverse center line substantially 10% of the extent of said head between the lower and upper edges of said eye.

3. A splitting axe according to claim 2 and further characterized by the center of gravity and the said retaining pin being located on opposite sides of said longitudinal center line.

* * * * *